US007398804B2

(12) United States Patent
Koch et al.

(10) Patent No.: US 7,398,804 B2
(45) Date of Patent: Jul. 15, 2008

(54) SEALED DOCKING ARRANGEMENT IN PARTICULAR FOR BAGS AND A METHOD FOR THE FILLING AND EMPTYING OF CONTAINERS IN AN ENVIRONMENTALLY-SEALED MANNER

(75) Inventors: Martin Koch, Neuenburg (DE); Gary Heath, Tamworth Staffs (GB)

(73) Assignee: GEA Buck Valve GmbH (DE)

( * ) Notice: Subject to any disclaimer, the term of this patent is extended or adjusted under 35 U.S.C. 154(b) by 391 days.

(21) Appl. No.: 10/494,187

(22) PCT Filed: Oct. 28, 2002

(86) PCT No.: PCT/EP02/12010

§ 371 (c)(1),
(2), (4) Date: Nov. 2, 2004

(87) PCT Pub. No.: WO03/037717

PCT Pub. Date: May 8, 2003

(65) Prior Publication Data

US 2005/0084181 A1 Apr. 21, 2005

(30) Foreign Application Priority Data

Oct. 29, 2001 (DE) ..... 201 17 669

(51) Int. Cl.
*B65B 1/04* (2006.01)

(52) U.S. Cl. ..... 141/315; 141/10; 141/114; 141/314; 141/317; 141/386; 383/68; 383/78

(58) Field of Classification Search ..... 141/10, 141/114, 313–319, 364, 383–386; 383/33–35, 383/68, 78
See application file for complete search history.

(56) References Cited

U.S. PATENT DOCUMENTS

| | | | | |
|---|---|---|---|---|
| 2,653,744 | A * | 9/1953 | Behr | 141/10 |
| 4,105,142 | A * | 8/1978 | Morris, Jr. | 222/158 |
| 5,150,735 | A | 9/1992 | Bandy et al. | |
| 5,295,507 | A | 3/1994 | Bandy et al. | |
| 5,853,207 | A | 12/1998 | S. Martin et al. | |
| 6,068,031 | A * | 5/2000 | Lataix et al. | 141/346 |
| 6,253,804 | B1 * | 7/2001 | Safabash | 141/97 |
| 7,104,293 | B2 * | 9/2006 | Lais et al. | 141/302 |
| 2003/0009858 | A1 * | 1/2003 | Goldberg et al. | 24/30.5 R |

FOREIGN PATENT DOCUMENTS

| | | | |
|---|---|---|---|
| DE | 695 04 581 | | 4/1999 |
| EP | 0 554 096 | | 4/1993 |
| GB | 2040862 | A * | 9/1980 |

* cited by examiner

*Primary Examiner*—Timothy L Maust
(74) *Attorney, Agent, or Firm*—Schiff Hardin LLP

(57) ABSTRACT

The sealed docking system comprises first and second coupling elements each having respective first and second coupling elements with respective first and second flexible receptacles. Each coupling element has a slot. The two coupling elements engage with one another. The coupling elements are flexible so that when force is applied the slots open.

21 Claims, 7 Drawing Sheets

SEALED DOCKING ARRANGEMENT IN PARTICULAR FOR BAGS AND A METHOD FOR THE FILLING AND EMPTYING OF CONTAINERS IN AN ENVIRONMENTALLY-SEALED MANNER

BACKGROUND

The invention concerns a sealed docking device between two essentially environmentally isolated receptacles, whereby each receptacle is at least in areas substantially flexible, in particular sack-shaped, and can be sealed or is sealed with a coupling element in order that it can be sealed or shut tight and opened when the coupling elements are tightly connected with one another. Furthermore, the invention concerns the coupling elements as well as a method for essentially environmentally-isolated filling and emptying of receptacles.

In many areas of industry (such as, for example, the food processing, chemical or pharmaceutical industries, products (as in the form of bulk material or fluids) are decanted from a mainly stationary first receptacle into a transportable second receptacle, or vice versa, whereby the industry in many cases is anxious to prevent a contamination of the products and/or the environment by the products. Since many products are very toxic to the human organism, even in extremely small quantities, or other products react very sensitively to the effect of air, industry effective coupling elements or docking devices have been developed that enable a filling or emptying of a receptacle in an isolated or at least dust-free state. For this, in the industry receptacles are conventionally filled via a double-flap technique that, although it proves to be very efficient, is also very cost-intensive due to the technical design as well as the materials used.

For example, known from DE 695 04 581 T2 is a sealed docking device according to the type between two environmentally-isolated receptacles that comprise a rigid, annular flange with a door. The flange as well as the door are preferably produced from a hard plastic material. The receptacles, which can be designed in the form of sacks, are preferably comprised of a soft plastic material. Plastic is suggested in order to keep the material costs low, since the sacks are specified for the one-time use. What is disadvantageous with this docking device is the (by design) very elaborate fabrication of the flange with its lifter mechanism serving for lifting, which unreasonably increases the production costs for a disposable object and is additionally user-unfriendly since it is unwieldy.

SUMMARY

It is therefore an object to further develop the sealed docking device according to the type and the coupling elements belonging to this docking device, as well as the known method for environmentally-isolated filling of receptacles with bulk material or fluids, such that the disadvantages of the prior art are surmounted, and that in particular the handling is simplified and the production costs are reduced.

This object is achieved with regard to the docking device in that each coupling element is elastically deformable for opening and closing.

DESCRIPTION OF THE PREFERRED EMBODIMENTS

Figure 1:
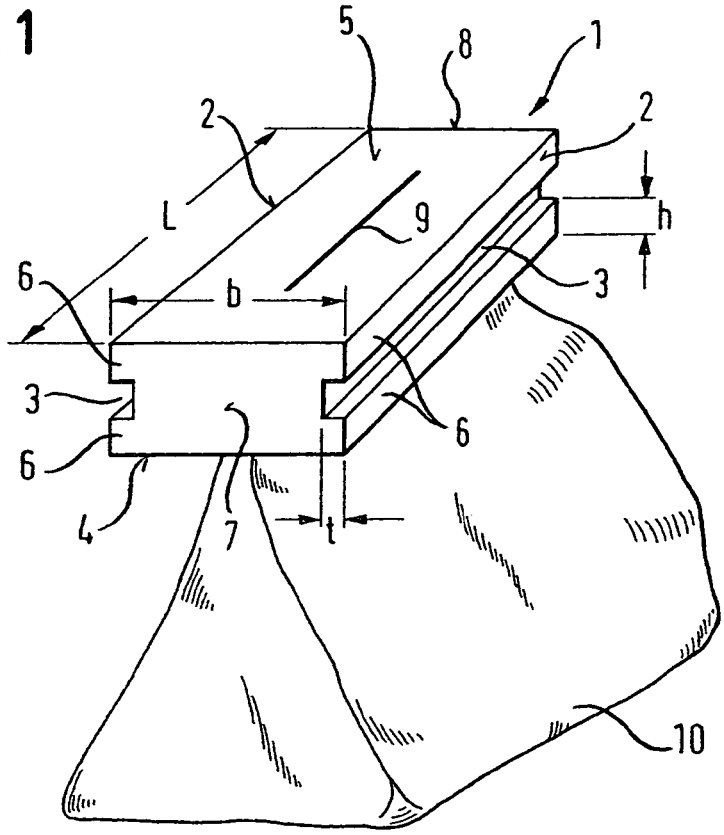
FIG. 1 is a perspective view of a first coupling element in the closed state.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

Each coupling element comprises at least one slot or opening that in the ground state in particular, is sealed tight via at least one sealing element, and can be opened via pressurization, preferably controlled and/or regulated, for filling and/or emptying of the corresponding receptacle.

It is also proposed that a first coupling element can be connected or provided with a device for pressurization, whereby via pressurization the first coupling element can be opened and, when in sealed connection to the other, second coupling element, forces an opening of the second coupling element.

A docking device is also characterized by at least one sealing device to secure a coupling element not in arrangement with another coupling element, whereby the sealing device preferably prevents an opening of the slot of the first coupling element given pressurization.

Among other things, a docking device is characterized by at least one guide device, preferably comprising a stopper (as in the form of a bead), a flat peg, a diaphragm wall and/or the like, and/or at least one groove or recess on one side and/or at least one web or projection on the other side to engage on at least one coupling element and/or one sealing device, whereby the guide device in particular ensures an alignment of the slots of both coupling elements to be contacted with one another.

A docking device is also characterized by at least one securing device to prevent the loosening of a sealed contact of the two coupling elements with one another or of a coupling element with the associated sealing device, whereby the securing device is preferably comprised of the guide device.

Alternatively, it is proposed that the guide device and/or the securing device is or are comprised by a first coupling element with the device for pressurization.

Among other things, the docking device is characterized in that in particular the top sides of the coupling elements can be laterally or axially connected. For example, the top sides of two corresponding coupling elements can be shifted sideways, i.e. laterally atop one another, as the case may be with the assistance of guide devices such as, for example, those described in the preceding.

It is also possible to design the coupling elements, in particular their top sides, such that the docking device can be obtained via an axial coupling of the coupling elements.

For this, it can be provided that a coupling element comprises at least one axial guide device, in particular an essentially circumferential, continuously or discontinuously axial edge web on the top side provided for coupling, whereby the edge web is dimensioned such that an essentially sealed, tight and/or arrestable closure is created with the coupling element to be docked. If, for example, the top sides facing one another of corresponding coupling elements form substantially smooth surfaces, a docking device can be sealed via an axial edge web, for example formed from two separate axial individual edge webs along opposite sides of a coupling element, in particular the longitudinal sides.

In a further embodiment, the sides of the coupling elements to be coupled comprise continuous circumferential axial elevations, for example in the form of edges or rims, that can be attached over the entire extent with a second coupling element and thus enable a sealed docking. In this case, at least one of the top sides of the coupling elements to be coupled comprises at least one continuous circumferential axial elevation that can be sealed with a second coupling element over the entire extent. In this manner, it leads to a sealed docking of two coupling elements, without that large surface areas of the sides of the coupling elements facing one another come into contact with one another.

According to a further embodiment, only one coupling element comprises the preceding specified circumferential axial edge or elevation on one side to be coupled, while the side of the second coupling element provided for docking forms an essentially uniform, in particular planar surface, in particular in the area of the coupling with the circumferential edge of the first coupling element.

It is normally sufficient for an environmentally-isolated filling when at least the circumferential axial elevation and an edge or border of the open passage or slot on the top side of the coupling element can be (in particular sealed) attached with the top side of a second coupling element to be docked, whereby in particular at least the circumferential axial elevation of the top side of the second coupling element and the edge or border of the open passage or slot of the top side of the first coupling element can be attached (in particular sealed) with the edge or border of the open passage or slot of the top side of the second coupling element. This embodiment enables a docking device to be designed from two essentially identical coupling elements, whereby the necessity does not apply to have to keep ready respective differently fashioned coupling elements that, however, correspond with regard to their fit.

An axial edge web, continuous or discontinuous, can be attached to the inner and/or outer wall of the circumferential axial elevation, in particular to the outer wall of the same, in order to affix the coupling elements. The continuous or discontinuous edge web (provided as a guide device) on the top side of the coupling element can thereby be placed on the side walls of the same, or be an integral component of the coupling element. If, for example, the axial extension of the side wall of the coupling element forms the continuous edge or elevation to attach to the second coupling element, the axial edge web serving as a guide device which exists on the outside of the circumferential edge and axially protrudes over this.

In addition or alternatively to the edge webs, the coupling elements can be affixed via arresting devices. For example, docked coupling elements can comprise rails or plug modules positioned adjacent to one another via which (for purposes of affixing) a connector block can be guided or, respectively, that can be plugged into one another. It is also possible to arrest coupling elements in a known manner via clamp fasteners or clips, in particular temporarily.

In a further preferred embodiment, at least one side of at least one coupling element of a docking device, in particular the side provided for docking, comprises at least in areas an adhesion and/or bonding layer. Preferred adhesion and bonding agents are those that normally allow a decoupling of coupling elements connected with one another but that at the same time possess a sufficient adhesion property in order to, for example, preferably permanently bind bulk material not completely decanted. If the coupling occurs via the previously specified circumferential edges or circumferential elevations adjacent to one another, an adhesion or bonding agent is preferably only provided in the region sealed by this circumferential edge of the top side of a coupling element to be docked. In an embodiment, both of the sides of the coupling elements to be coupled are provided with an adhesion or bonding agent. However, it is as a rule completely sufficient for coupling to provide only the side of the first coupling element with an adhesion or bonding agent. In this manner it is already frequently prevented that bulk material remaining in or on the passage slot and not completely transferred contaminate the environment upon decoupling of the coupling elements, for example after the end of a filling event. Dust-like or fine-particle products that remain in the area of the coupling elements after the filling event are bound with the aid of the bonding agent and can therefore no longer escape into the environment. The use of an adhesion or bonding layer has proven to be of great value, in particular in the handling of products that can cause damage to the environment or health. It has likewise proven to be advantageous to use a bonding layer that can be detached from its base. For example, bonding ribbon or film adhesive on both sides are suitable, whereby the adhesive properties of the respective film sides are preferably adapted to their specific use in order to achieve a reliable and permanent connection to the adhesive base, meaning, for example, the top side of the coupling element, and on the other hand to ensure with the second adhesion or bonding layer the prevention of a residual contamination with bulk material.

According to a further inventive embodiment, it is provided that a coupling element, essentially environmentally isolated, is connected with or can be connected with at least one (in particular translucent or transparent) flexible receptacle comprising at least one extraction device, in particular in the form of a spoon, a spatula or a sealable receptacle, in particular for sample extraction.

It can thereby be provided that the extraction device is connected or can be connected at least in regions with the flexible receptacle, in particular at its back or bottom end. Since an extraction device is already provided in a flexible receptacle, smaller quantities of material can also already (in a safe and simple manner) be extracted from a receptacle that possesses a corresponding coupling element with which a docking device can be designed. The receptacle provided for the sample extraction and comprising the extraction device is preferably adapted with regard to its size to the respective required sample quantity and the necessary extraction device. In this manner, the sample quantities can be extracted from a receptacle for the purpose of further analysis without damaging it, or without having to effect another permanent opening or sealing device of the receptacle. The necessity is thereby likewise done away with to have to work in specially prepared or isolated rooms that, for example, comprise a permanent air extraction, in particular given the sampling of substances posing a risk to health and/or are environmentally dangerous.

Additionally, a docking device is characterized in that each receptacle is attached, in particular bonded to the corresponding coupling element in the region of its slot.

It can thereby be provided that each receptacle is attached to the corresponding coupling element at the inner surface of the slot.

It is further proposed that the slot is effected as a simple slot or cross-slot.

It is also thereby proposed that at least one, in particular every coupling element, comprises a food-compatible plastic such as EPDM, and/or silicon, or that at least one, in particular every coupling element is essentially comprised of bulk material, in particular polyethylene or polypropylene. At least one, in particular every coupling element, at least in areas, in particular at the locations that can come in contact with bulk material, comprises a coating that comprises bulk material or is substantially comprised of bulk material, in particular polyethylene or polypropylene. LD-polypropylene is in this context also particularly preferably resorted to as a component or material for the coupling element or a coating of the same. This approach has, for example, proven to be advantageous in the decanting of plastic granulates, for example in processing devices such as extruders or injection molding devices. The material of the coupling element or its coating can thereby be adapted to a plurality of (for example, granulated) plastic materials to be decanted, in particular when, for example, high-purity plastic products are to be produced such as are used, among other things, for electrical insulation. Even abrasion of the coupling elements generated in the decanting or particles chipped by this have no disadvantageous effect on the purity of the bulk material in this embodiment.

It is also proposed that each coupling element comprises at least one spring element, preferably made of metal.

Also, a docking device is characterized in that the receptacles, the coupling elements and/or the sealing devices are commonly recyclable.

Finally, it can be provided that the receptacle to be emptied is part of a filling or production unit, and that the receptacle to be filled comprises a sack or container receptacle, or that the receptacle to be emptied represents a sack or a container receptacle, and that the receptacle to be filled is a part of a production unit.

Furthermore, a coupling element for environmentally-isolated filling and/or emptying of receptacles is provided that is firmly or detachably connected or can be connected in an essentially environmentally isolated manner on a first side with at least one receptacle (substantially flexible at least in areas), whereby the coupling element is elastically deformable at least in areas and comprises a second side, in particular a top side that can be essentially tightly and in particular reversibly docked to a second side, in particular a top side of a second coupling element. Thus the stated coupling element is sealed in the ground state and can be reversibly opened under elastic deformation, in particular over at least one slot, such that a passage exists from the first side of the coupling element to the second side of the coupling element.

It can be provided that the top side of the coupling element comprises at least one continuous circumferential axial elevation that can be attached, in particular sealed with a second coupling element over the entire extent.

A preferred embodiment is further characterized in that the circumferential axial elevation and an edge or border of the openable passage or slot on the top side of the coupling element can be attached (in particular sealed) with the top side of a second coupling element to be docked. In particular at least the circumferential axial elevation of the top side of the first coupling element and the edge or border of the openable passage or slot of the top side of the first coupling element can be attached (in particular sealed) with the edge or border of the openable passage or slot of the top side of the second coupling element.

In a further embodiment an essentially axial guide device is provided, in particular a continuous circumferential or discontinuous axial edge web on the top side of the aforementioned coupling element, in particular on the circumferential axial elevation for formation of a sealed, tight and/or arrestable closure with a dockable second coupling element.

In a preferred embodiment, the coupling element possesses at least one guide device comprising at least one groove or recess or at least one web or projection, in particular in the area of a side surface connecting the top and bottom side, to engage on a second coupling element additional information a sealing device.

Particularly preferred are also such embodiments that are characterized in that at least one side of the coupling element, in particular the second side provided for environmentally-isolated docking to a second coupling element, comprise at least in regions adhesive agent and/or a glue, in particular an adhesion or bonding layer. Suitable adhesion or bonding agents themselves do not generally contribute to the contamination of the bulk material, and are in particular food- and/or pharmaceutical-compliant or, respectively, unproblematic from food- and medical-legal points of view.

Furthermore, it can be provided that the peripheral edge region of the acceptance opening of the flexible receptacle is sealed or can be sealed with the circumferential edge (in particular the walls closely adjacent to one another in the ground state) of the passage at least adjacent to the first side, with the surface of the first side, or with the side connecting the first and second side, with or without assistance of a clamping belt or elastic.

The coupling element is further characterized by an in particular circumferential, continuous or discontinuous axial edge on the second side of the aforementioned coupling element to form a sealing and/or positive-fit closure with a dockable second coupling element.

In an embodiment, a coupling element is provided that provides at least one (in particular translucent or transparent) flexible receptacle, connected with this in an environmentally-isolated manner, in which at least one extraction device is provided, in particular in the form of a spoon, spatula or in particular sealable receptacle.

The object concerning the method for (in particular environmentally-isolated) filling and/or emptying of receptacles is achieved in that the coupling element is elastically deformable at least in regions, in particular comprises an elastic base body and a second side, in particular a top side, that is essentially tightly and in particular reversibly dockable with a second side, in particular a top side of a second coupling element, whereby the aforementioned coupling element is sealed in the ground state, and under elastic deformation at least one passage can be reversibly opened, in particular in the aforementioned elastic base body, such that a passage exists from the first side of the coupling element to the second side of the coupling element.

It can hereby be provided that the first and/or second coupling element is sealed tight via at least one sealing device, for example a sealing clamp, before the formation of a docking device.

According to a particularly preferred embodiment, it is provided that each coupling element comprises at least one slot, whereby a first coupling element is charged with pressure to form an opening, and whereby a second coupling element, located in sealed connection with the first coupling element, is charged with pressure to form an opening, whereby a passage from the first receptacle to the second receptacle is designed.

It is of particular advantage when the receptacle to be emptied is multiply, momentarily charged with pressure during the emptying event.

The first receptacle can also be stationary, and the second receptacle can be portable.

According to a further embodiment, the second receptacle is only flexibly implemented in the area of the second coupling element.

Furthermore, it can be provided that the second receptacle is a component of a filling or production device, or is connected with a production device, and that the first receptacle is filled via the filling or production device, or that the production device is filled via the first receptacle.

A method has proven to be particularly advantageous in which one slides the second coupling element over the first coupling element such that it seals, whereby one slides the top side of the second coupling element over the top side of the first coupling element, in particular laterally, such that it seals, whereby in particular opposite second guide devices (in particular in the form of edges, in particular lengthwise edges) of the second coupling element engage in corresponding first guide devices located on the opposite side (in particular in the form of grooves) of the first coupling element.

It can hereby be provided that a sealing device sealing the first coupling element tight, in particular a sealing clamp, is shifted downwards by the first coupling element upon insertion of the edges of the second coupling element into the grooves of the first coupling element.

It has proven to be particularly preferred that the top sides of the coupling elements are axially connected, in particular via at least one axial guide device.

It is realized that, via the embodiment of a docking device to fill or, respectively, empty receptacles flexible at least in regions, an effective contamination-free decanting of bulk material and/or fluids is ensured, a simpler (in terms of design) assembly offers a high reliability and security since defects due to technical shortcomings are nearly eliminated, and at the same time lower production and material costs result in that the coupling elements to open the entrance to the receptacles connected therewith are elastically deformable.

Additionally, given the filling or emptying of receptacles, a docking device provides the entire cross-section in the passage opening, whereas the use of double flaps in the known double-flap technology reduces the cross-section.

The docking devices as well as coupling elements are in particular suited for environmentally-isolated filling of flexible receptacles directly from filling or production systems. These docking devices and coupling elements can also be used reliably and without problems in order to be able to fill or, respectively, empty sacks, production systems, formulation systems, extruders and injection molding and glass shaping machines without contamination. In particular when it is necessary to ensure that exclusively the materials provided for the production are used, for example in the introduction of educt materials in the synthesis of pharmaceutical products, the docking device has or the coupling elements have proven to be extremely advantageous. For example, high-purity plastics can also be obtained, in that via the docking device granulate is directly filled into a plastic processing system, for example an extruder. Thus filling or emptying stations in production systems can be designed substantially more simply and more cost-effectively with the docking device without having to accept losses with regard to contamination-free work. The coupling elements and docking devices thus ensure both that the environment is not polluted with bulk material residues and that the bulk material to be transferred is not contaminated by substances and particles from the environment. Surprisingly, it was also found in this context that residual contaminations can be completely prevented via adaptation of the material or coating used for the docking devices and coupling elements to the bulk material to be decanted. In these cases, even abrasion in the coupling elements ensuing in the decanting does not lead to a contamination of the bulk material, for example in the case of polymer granulate. The coupling elements or docking devices thus contribute both to environmental and product protection.

As is to be learned from FIG. 1, a docking device comprises a first coupling element 1 in the form of an elastomer body (designed oblong) with a side length L that comprises a groove 3 (designed rectangular) in each of its side surfaces 2. The grooves 3 are arranged in the side surfaces 2 such that on each side surface, one web 6 of the height h and the depth t is designed, both by the underside 4 of the elastomer body with regard to the groove 3 and by the top side 5 with regard to the groove 3, such that the front side 7 as well as the back side 8 of the elastomer body respectively exhibit a maximum width b in comparison to their minimal dimension of b−2t in the area of the grooves 3. In the elastomer body, a passage or slot 9 is applied centrically between the side surfaces, the passage or slot 9 being implemented continuously from the top side 5 to the underside 4 and extending over a length that is less than the side length L of the elastomer body, preferably in the range of 50 to 600 mm. A receptacle, for example in the form of a sack 10, is attached to the first coupling element 1, whereby the sack 10 can, for example, be bonded with the inner surface (see FIG. 2) of the elastomer body formed by the passage or slot 9.

According to FIG. 1, the first coupling element 1 is exposed to no external forces whatsoever, and is thus located in its closed state in which the passage or slot 9 is sealed tight. In this closed state, the inside of the sack 10 is sealed from the environment. For this purpose, the inner surface 11 of the slot 9 can be provided with additional sealing elements (not shown) such as lips or beads.

Figure 2:
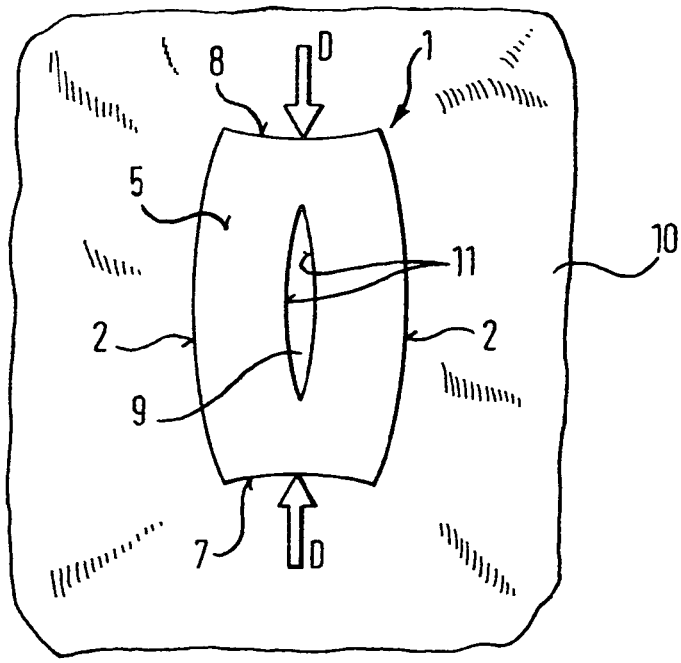
FIG. 2 is a plan view of the first coupling element of FIG. 1 in the partially-opened state.

In FIG. 2, a partially open state of the first coupling element 1 is shown that results when the first coupling element 1 is charged with a force on its front side 7 and back side 8, as indicated by the arrow D in FIG. 2. In this open state, the sack 10 bonded to the inner surface 11 of the slot of the first coupling element 1 can be filled or emptied such that it is metered. If the externally applied force is removed from the first coupling element, it goes back to its closed state shown in FIG. 1.

Figure 3:
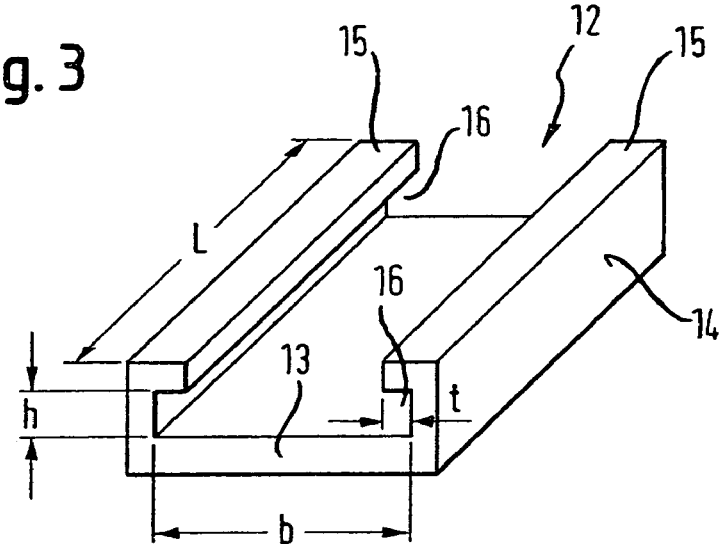
FIG. 3 is a perspective view of a sealing clamp.

Shown in FIG. 3 is a sealing device in the form of a sealing clamp 12 for the first coupling element as a further component of the inventive docking device. This sealing clamp 12 comprises a base plate 13 (designed from essentially dimensionally stable material, for example hard plastic) with walls 14 of side length L arranged at a lateral distance b from one another. Edges 15 are molded on the walls 14 such that a recess 16 forms on the walls 14 on both sides of the base plate 13. The recesses 16 are thereby dimensioned with a height h and a depth t such that the sealing clamp 12 can be directed over the first coupling element 1 with friction-fit to engage the webs 6 in the recesses 16.

Figure 4:
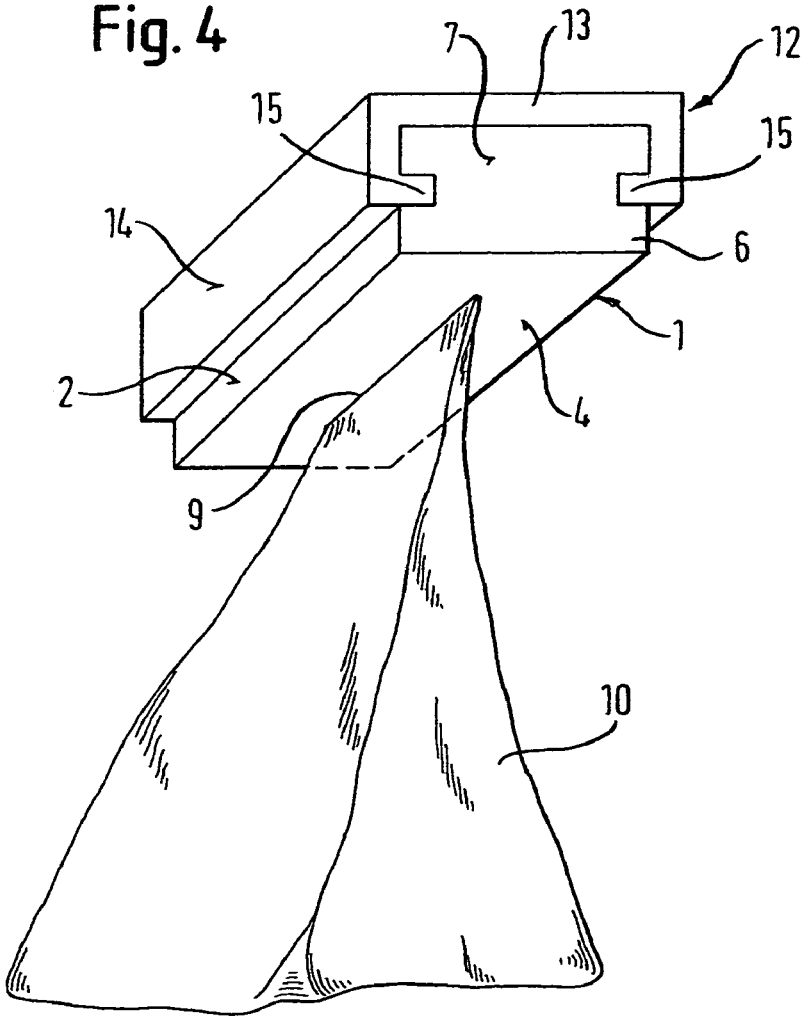
FIG. 4 is a perspective view of the sealing clamp of FIG. 3 in effective connection with the first coupling element of FIGS. 1 and 2.

In FIG. 4, an assembly is shown in which the sealing clamp 12 of FIG. 3 is mounted on the first coupling element 1 of FIGS. 1 and 2 in order to prevent (via the form stability of the sealing clamp 12) an unintentional opening of the slot 9 of the first coupling element 1, and thus of the sack 10. Given a more or less sliding precision of register, the sealing clamp 12 or the first coupling element 1 can respectively comprise a small bead, tooth or the like (not shown) that engages in a correspondingly designed negative form (likewise not shown) of the first coupling element 1 or of the sealing clamp 12 in order to prevent such an unwanted sliding and opening of the sack 10, whereby this connection can however be released via light expended pressure.

Figure 5:
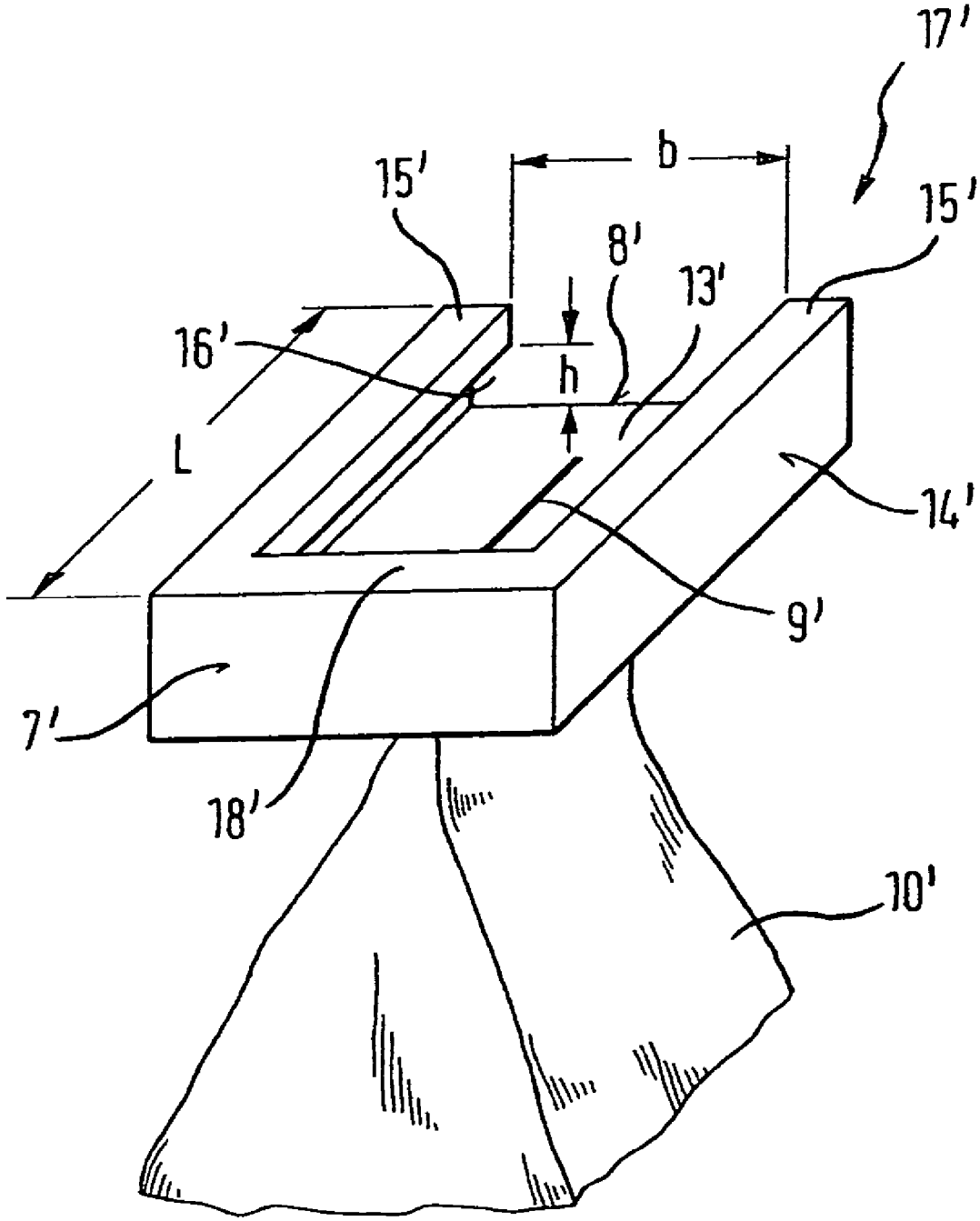
FIG. 5 is a perspective view of a second coupling element.

FIG. 5 shows a second coupling element 17' of the docking device, made from an elastomer body that is designed essentially analogous to the sealing clamp 12, with a base plate 13', walls 14' and edges 15' to provide recesses 16'. However, the base plate 13' additionally comprises a continuous slot 9' similar to the first coupling element 1, on whose inner surface is attached (for example bonded) a flexible second receptacle in the form of a sack 10'. The second coupling element 17' additionally comprises on its front side 7' a stopper 18' in the form of a diaphragm wall.

Figure 6:
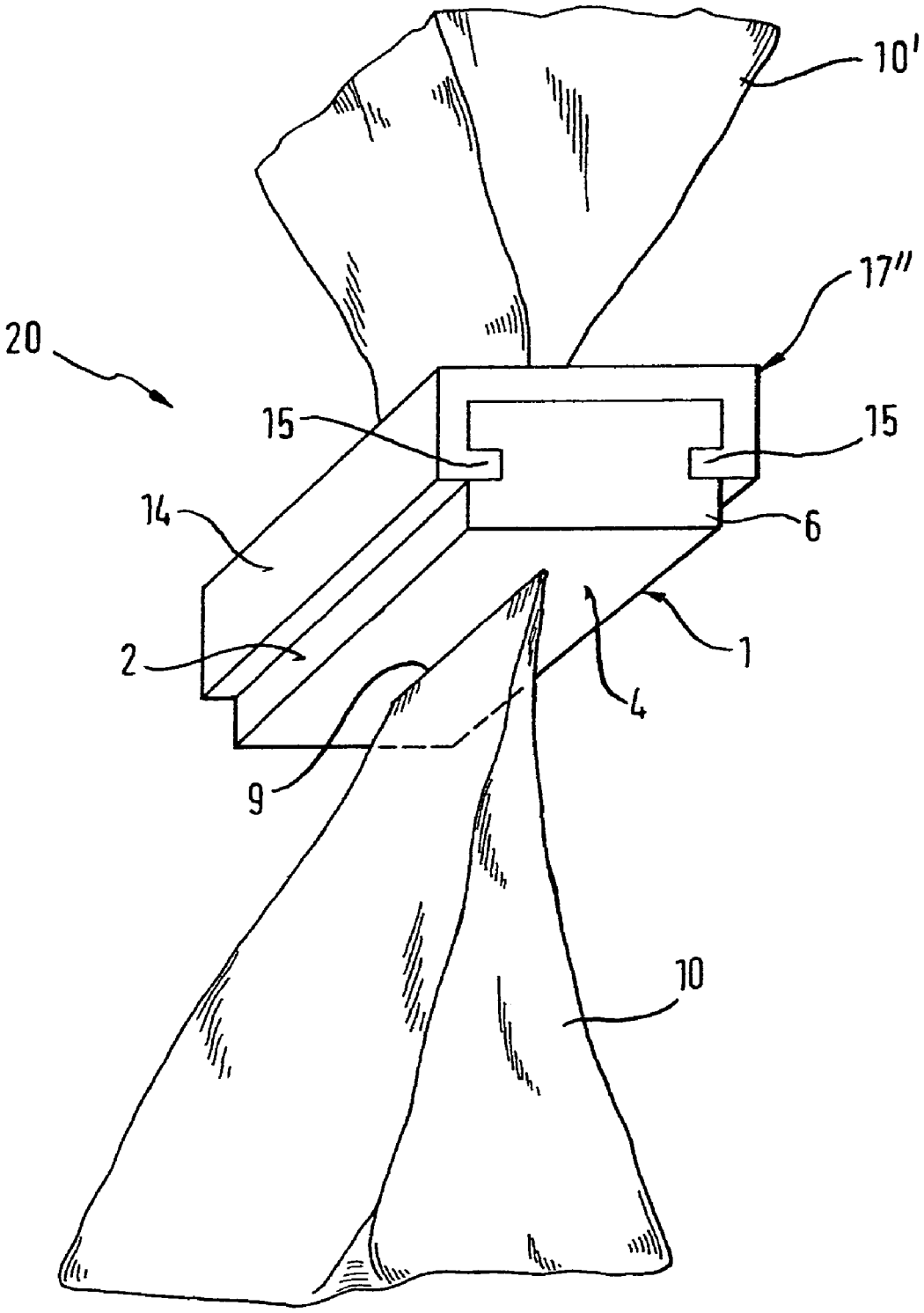
FIG. 6 is a perspective view of a docking device comprising two coupling elements and two flexible receptacles.

FIG. 6 shows a docking device 20 that is comprised of a first coupling element 1 according to FIG. 1 or 4 and a second coupling element 17" corresponding to coupling element 17' according to FIG. 5, however without stopper 18' in the form of a diaphragm wall on the side 7'. The reference characters used in FIG. 6 have the meaning previously discussed in FIGS. 4 and 5. A docking is achieved in that one slides the top sides 5 of the coupling elements 1 and 17" laterally on top of one another. Naturally, it is likewise possible to provide a docking device with a second coupling element analogous to the coupling element 17', which possesses a stopper 18'.

Figure 7:
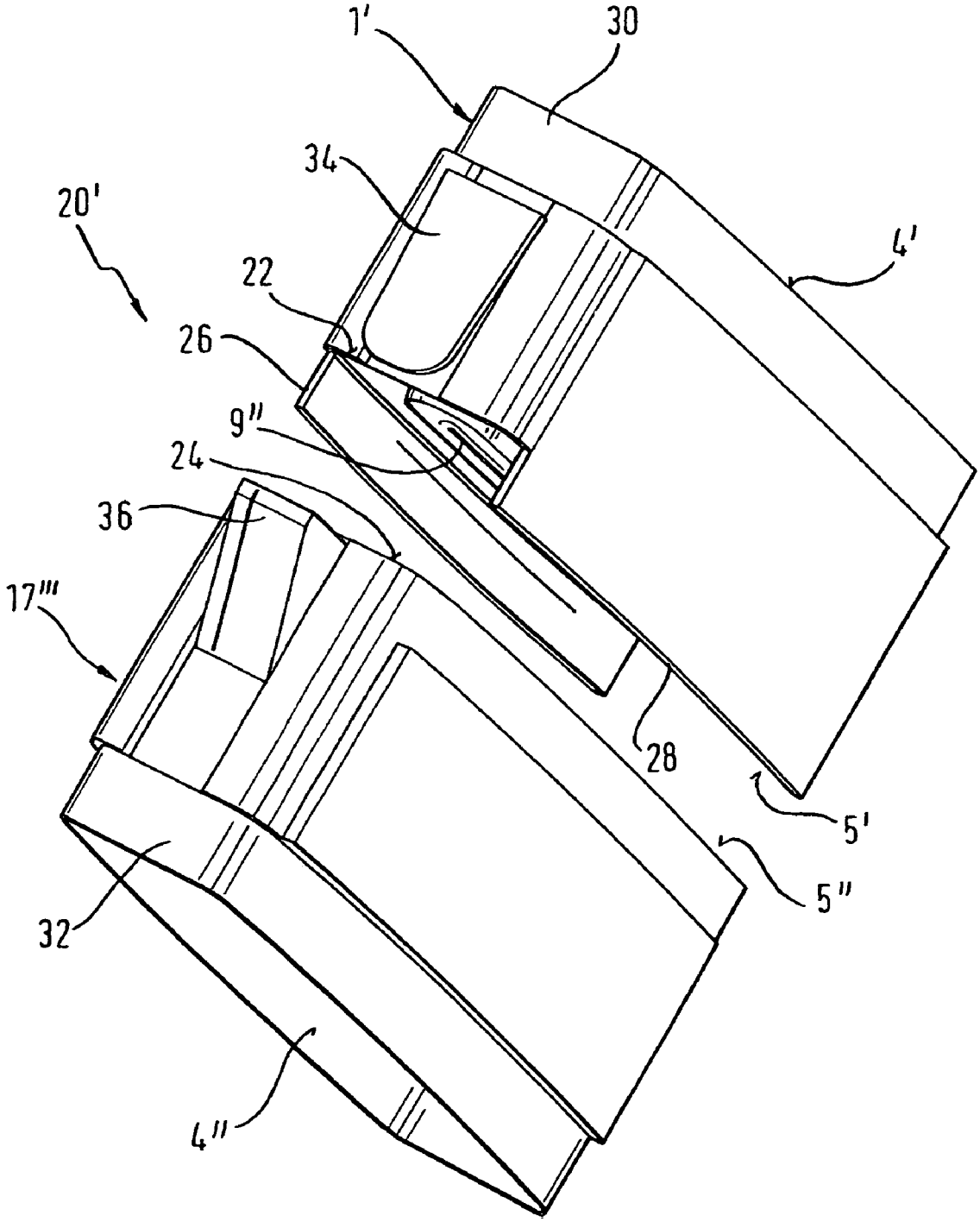
FIG. 7 is a perspective view of a first and second coupling element of an alternative docking device.

A first and second coupling element 1', 17''' of an alternative embodiment of a docking device 20' just before the docking is to be learned from FIG. 7. While the coupling elements 1, 17" are guided sideways or laterally over one another in the docking device according to FIG. 6 to form a sealed unit, the coupling elements 1', 17''', in particular their top sides 5' and 5", are fashioned such that an axial docking occurs. The flexible receptacles typically attached to the undersides 4' and 4" such that they are sealed from the environment have, for reasons of better clarity, not been shown. The top side 5' of the first coupling element 1' possesses a contour shape that substantially corresponds to that of the top side 5" of the second coupling element 17'''. In the case of the environmentally-sealed docking, the circumferential edges 22 and 24 thereby come to lie atop one another. With guide rails 26 and 28 on the opposite longitudinal sides of the coupling element 1', the axial docking is eased, the existing docking device is substantially stabilized, and the environment impermeability is increased.

Flexible receptacles can either be connected directly with the slots 9" (sealed in the ground state of the connection elements) or with their passage walls, similar to FIGS. 1, 4 and 5. Alternatively, the circumferential edge 30, 32 on the undersides 4' and 4" of the coupling elements 1' and 17''' can also be used in order to attach a flexible receptacle from the inside as well as preferably from the outside, for example under elastic initial tension, such that it is sealed from the environment. Such an attached receptacle can, for example, also be attached with a band, belt or a buckle on the circumferential edge. In this manner, the reuse of the coupling element is achieved in a very simple manner. The connection of the coupling elements 1' and 17''' can in particular be stabilized by affixing elements 34 and 36, in particular on the opposite sides of the coupling elements 1' and 17'''. For example, a sealing clamp (not shown) can be guided, in particular with perfect fit, via affixing elements 34 and 36 comprising groove-shaped recesses. In a particularly preferred embodiment, this sealing element is designed with gripping surfaces or gripping elements via which an elastic deformation of the coupling elements 1' and 17''' of the docking device can be achieved particularly simply. The affixing elements 34 and 36 can be designed fundamentally identical or, as shown in FIG. 7, different. In general, arbitrary forms are possible as long as they allow or enable an affixing and/or elastic deformation of the connection elements.

Figure 8:
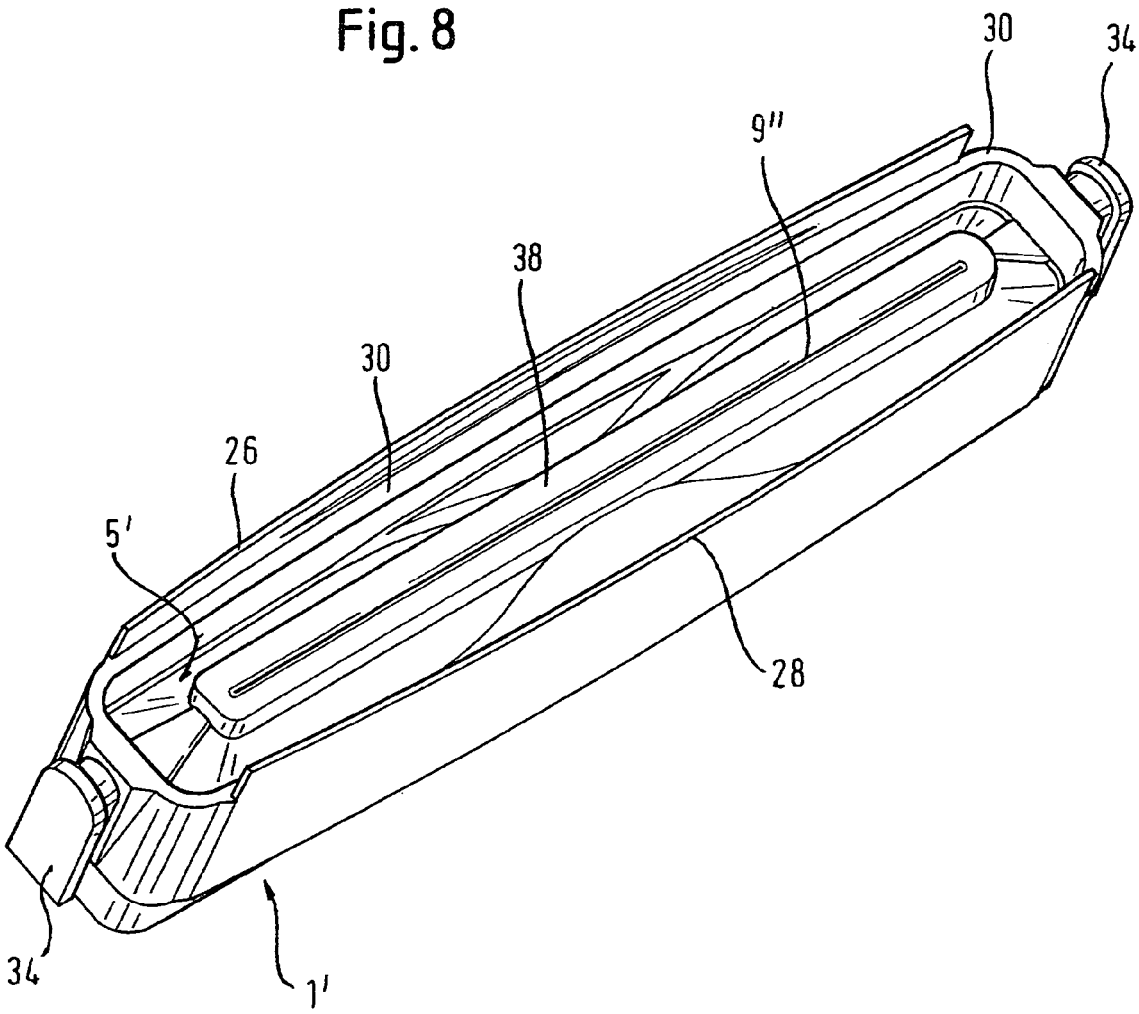
FIG. 8 is a perspective view of a first coupling element according to FIG. 7.

FIG. 8 shows a first coupling element 1' from the view of the top side 5'. The guide rails 26 and 28 mounted on the longitudinal sides are placed on the circumferential edge 30. The narrow sides comprise affixing elements 34. The slot 9" extends in the central direction substantially parallel to the longitudinal sides of the coupling element. The shown coupling element 1" is located in the ground state, according to which the slot 9" is closed. In a preferred embodiment, in particular the top side 5' or parts thereof is provided (not shown) with an adhesion layer to affix residual bulk material. In that the guide rails 26 and 28 are only located on the longitudinal sides of the coupling element 1', in addition to the axial docking the shown embodiment also enables a sideways sliding or docking of the coupling elements. A docking available via the combination of lateral and axial relative motions of the coupling elements is also possible.

Figure 9:
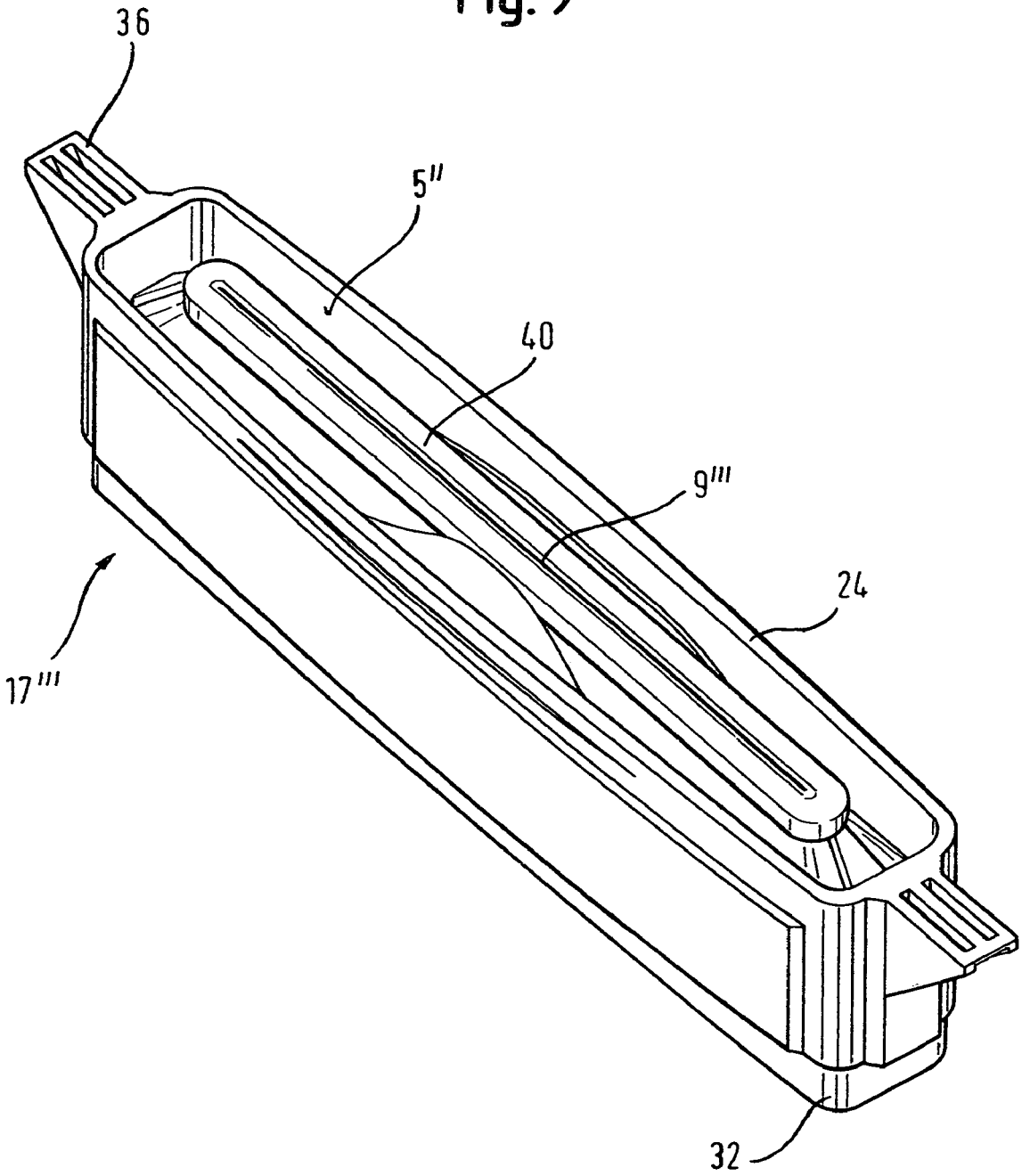
FIG. 9 is a perspective view of a second coupling element according to FIG. 7.

In FIG. 9, the coupling element 17''' is shown from its top side 5", comprising slot 9'''.

A filling event using a coupling element shown in FIG. 5 or, respectively, a docking device based thereupon is subsequently specified.

A filling of the second sack 10' with bulk material (not shown) from the first sack 10 is specified in the following:

The bulk material is initially located in sack 10, which is held closed by the sealing clamp 12 as indicated in FIG. 4. In order to decant the bulk material into the sack 10' located at the second coupling element 17', one simply shifts the second coupling element 17' over the first coupling element 1, in that the edges 15' of the second coupling element 17' is inserted into the grooves 3 of the first coupling element 1, and at the same time the sealing clamp 12 is slid downwards on its seat on the first coupling element 1. The grooves 3, in combination with the edges 15 engaging therein and the webs 6 of the first coupling element 1 lying in the recesses 16' of the second coupling element 17', thereby act as a guide device, while the grooves 3 as well as the edges 15' positioned therein simultaneously serve as a securing device for axially securing against a detaching of the coupling elements 1, 17' from one another when the sacks 10 and 10' are arranged perpendicular to one another for decanting. The second coupling element 17' is correctly mounted on the first coupling element 1 when the front side 7 of the first coupling element 1 abuts against the stopper 18' on the front side 7' of the second coupling element 17', and thus the slot 9 comes to lie exactly over the slot 9'.

If the front sides 7, 7' and the back sides 8, 8' of the coupling elements 1, 17' are directly or indirectly charged with pressure via the respective other coupling element 17', 1, the slots 9, 9' spread apart and the bulk material can arrive in the second sack 10' from the first sack 10. The charged pressure can hereby be regulated such that a finely dosed filling of the second sack 10' or emptying of the first sack 10 is possible. Via the flexible design of the coupling elements 1, 17', the emptying of the first sack 10 or the filling of the second sack 10' can additionally be made easier in that, via multiple brief pressure charges, the first sack 10 breathes similar to a bellows, whereby on the one hand bulk material that possibly adheres to the walls of the first sack 10 can be detached, and on the other hand a higher packing density is achieved in the second sack 10' to be filled, since bulk material bonds (not shown) are destroyed by the corresponding flexing work.

In the coupling elements 1, 1', 17', 17", spring elements (not shown), preferably made from metal, can be arranged in the periphery of the slots 9, 9', 9", the spring elements being able to be injection molded with an elastomer during the production and displacing of the coupling elements 1, 1', 17', 17" in specific directions via exertion of pressure in a lightly pre-stressed state. Additionally, for the same purpose additional collars made from an elastically deformable material can be arranged around the coupling elements 1, 1', 17', 17". Likewise, grooves, recesses, webs, edges and the like can be arranged on the top sides of the coupling elements instead of the side walls.

Naturally, both receptacles do not have to be implemented in the form of sacks. For example, the docking device is particularly advantageous in the case of the filling of a first, sack-like receptacle directly from a production device, for example with tablets or pills. For this purpose, the second receptacle could only be implemented flexibly in the area of its coupling element in order to enable an opening and closing of the coupling element for deformation of the same. In such a case, it would also be of advantage to apply pressure to open the coupling elements at the first coupling element connected with the sack-like receptacle, such that this first coupling element would be designated as an active part and to transfer aforementioned pressure to the second coupling element connected with the production device that would then assessed as a passive part.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

The invention claimed is:

1. A docking device for use between first and second essentially environmentally isolated receptacles, each receptacle being at least in regions substantially flexible, comprising:

first and second respective coupling elements mounted to the first and second receptacles respectively and which respectively seal or open the respective receptacle, the coupling elements being tightly connected with one another;

each coupling element being elastically deformable for opening and closing;

the coupling element being at least one of laterally and axially connected; and at least a top side of the first coupling element to be coupled comprising at least one continuous circumferential axial elevation attached over an entire extent with the top side of the second coupling element.

2. A docking device according to claim 1 wherein each coupling element comprises at least one slot sealed tight in a base state with at least one sealing element, and which can be opened via pressurization for filing or emptying of the corresponding receptacle.

3. A docking device according to claim 1 wherein the first coupling element is provided with a device for pressurization, whereby the coupling element is opened via pressurization and, when connected to the second coupling element, an opening of the second coupling element is forced.

4. A docking device according to claim 1 wherein at least one sealing device prevents an opening of a slot of the first coupling element when subjected to pressurization.

5. A docking device according to claim 1 wherein at least one guide device is provided for alignment of slots of both coupling elements to be connected with one another.

6. A docking device according to claim 1 wherein at least one sealing device is provided to prevent detaching of a sealed connection of both coupling elements with one another.

7. A docking device according to claim 5 wherein the guide device is comprised of the first coupling element with a device for pressurization.

8. A docking device according to claim 1 wherein the first coupling element comprises at least one guide device on a side provided for coupling, the guide device being dimensioned such that an essentially sealed, tight closure is created with the second coupling element to be docked.

9. A docking device according to claim 1 wherein a side provided for docking of at least one of the coupling elements at least in areas has a bonding layer.

10. A docking device according to claim 1 wherein at least one of the coupling elements is connected in an essentially environmentally isolated manner with the respective flexible receptacle comprising at least one extraction device for sample extraction.

11. A docking device according to claim 10 wherein the extraction device is connected with the flexible receptacle, at least in areas at least at one of its back and bottom end.

12. A docking device according to claim 1 wherein the coupling elements comprise a plastic.

13. A docking device according to claim 1 wherein each coupling element comprises at least one spring element.

14. A docking device according to claim 1 wherein at least one of the receptacles, the coupling elements, and a sealing device are recyclable.

15. A docking device according to claim 1 wherein one of the receptacles is part of a filling unit, and the receptacle to be filled comprises a sack and that one of the receptacles is to be emptied and comprises a sack.

16. A docking device according to claim 1 wherein the coupling elements are for filling flexible receptacles.

17. A docking device according to claim 1 wherein the coupling elements are filling production systems comprising at least one of the elements formulation systems, extruders, injection molding, and blow molding machines.

18. A docking device according to claim 1 wherein the coupling elements are for at least one of filling and emptying of pharmaceutical products into or out of the respective receptacle.

19. A docking device for use between first and second essentially environmentally isolated receptacles, each receptacle being at least in regions substantially flexible, comprising:

first and second respective coupling elements mounted to the first and second receptacles respectively and which respectively seal or open the respective receptacle, the coupling elements being tightly connected with one another;

each coupling element being elastically deformable for opening and closing;

the coupling element being at least one of laterally and axially connected;

at least a top side of the first coupling element to be coupled comprising at least one continuous circumferential axial elevation attached over an entire extent with the top side of the second coupling element; and at least a circumferential axial elevation and an edge of an openable passage on the top side of the first coupling element being attached with the top side of the second coupling element to be docked.

20. A docking device for use between first and second essentially environmentally isolated receptacles, each receptacle being at least in regions substantially flexible, comprising:

first and second respective coupling elements mounted to the first and second receptacles respectively and which respectively seal or open the respective receptacle, the coupling elements being tightly connected with one another;

each coupling element being elastically deformable for opening and closing;

each receptacle being bonded to the corresponding coupling element in an area of a slot thereof; and the slot comprising one of a simple slot and a cross-slot.

21. A docking device according to claim 20 wherein each receptacle is attached to an inner surface of the slot of the corresponding coupling element.

* * * * *